US006813846B2

(12) United States Patent
Yoshida

(10) Patent No.: US 6,813,846 B2
(45) Date of Patent: Nov. 9, 2004

(54) DRYING DEVICE

(75) Inventor: Futoshi Yoshida, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/106,029

(22) Filed: Mar. 27, 2002

(65) Prior Publication Data

US 2002/0139007 A1 Oct. 3, 2002

(30) Foreign Application Priority Data

Mar. 28, 2001 (JP) ..... 2001-092522

(51) Int. Cl.[7] ..... F26B 13/00

(52) U.S. Cl. ..... 34/443; 34/583; 34/619; 34/624; 34/216

(58) Field of Search ..... 34/508, 509, 510, 34/582, 583, 587, 624, 657, 618, 343, 348, 350, 360, 619, 620, 621, 633, 654, 431, 434, 443, 444, 445, 452, 454, 460, 465, 477, 507, 639, 640, 641; 219/388; 392/417

(56) References Cited

U.S. PATENT DOCUMENTS 1,072,512 A * 9/1913 Schewczik ..... 34/657
3,122,427 A * 2/1964 Doleman ..... 34/95
3,771,239 A * 11/1973 Minoda et al. ..... 34/156
3,800,432 A * 4/1974 Miyata et al. ..... 34/151
4,551,926 A * 11/1985 Aufderhaar ..... 34/23
4,622,762 A * 11/1986 Reed ..... 34/638
4,932,139 A * 6/1990 Lehtinen ..... 34/41
5,167,080 A * 12/1992 Burkhardt et al. ..... 34/82
5,345,061 A * 9/1994 Chanasyk et al. ..... 219/388
5,504,271 A * 4/1996 Curtis et al. ..... 118/66
5,768,799 A * 6/1998 Delaunay et al. ..... 34/247
5,847,362 A * 12/1998 Sissons et al. ..... 219/388
5,902,502 A * 5/1999 Sissons et al. ..... 219/388
6,006,446 A * 12/1999 Pagendarm ..... 34/633
6,134,811 A * 10/2000 Berger et al. ..... 34/618
6,351,896 B1 * 3/2002 Vainio ..... 34/428
6,463,674 B1 * 10/2002 Meyers et al. ..... 34/304

* cited by examiner

*Primary Examiner*—Kenneth Rinehart
(74) *Attorney, Agent, or Firm*—Sughrue Mion, PLLC

(57) ABSTRACT

A photosensitive material is dried by radiating heat from a guide plate, having high emissivity, which is disposed along a conveying path and is heated by a ceramic heater. Further, the photosensitive material is dried by a warm air, which is heated by a heater, blown onto the photosensitive material from nozzles. In the drying, because the warm air is also heated by the heated guide plate, the warm air can be risen to a predetermined temperature efficiently. Accordingly, because transferring the radiating heat and the blowing the warm air are performed at a same position (a same member), the drying can be performed efficiently without enlarging the device.

7 Claims, 10 Drawing Sheets

DRYING DEVICE

BACKGROUND OF THE INVENTION

1. Field of the Invention

The present invention relates to a drying device for drying a wet image recording medium.

2. Description of the Related Art

In recent years, printing devices utilizing a digital exposure, namely, digital photographic printers, have been put into practice. The digital photographic printer is a device in which an image recorded on a film is read in a photoelectric manner, the read image is converted to digital signal, the digital signal is subject to various image processings to obtain image data for recording, an image (a latent image) is formed on a photosensitive material by scanning and exposing the photosensitive material with a recording light modulated in accordance with the image data, the photosensitive material is subject to developing processing, and a print (a photograph) is output.

A processor included in the digital photographic printer described above is provided with a developing section and a drying section. The developing section performs the developing processing in which the photosensitive material on which the latent image is formed is immersed in a developing tank. The drying section dries the developed photosensitive material.

A structure of the drying section for drying the photosensitive material thereat is well known in which a hot (warm) air is blown to the conveyed photosensitive material. Also, in recent years, a structure of the drying section in which radiation heat is utilized to improve a drying speed of the photosensitive material is proposed.

It is a disadvantage of the structure of the drying section in which the warm air is blown to the photosensitive material described above that drying efficiency is low because large amount of heat losses, from a side surface of a duct providing the warm air, to the outside.

When the drying section is structured such that the radiation heat is also utilized, it is necessary to provide both a section for drying in which the warm air is blown and a section for drying in which the radiating heat is utilized, at the drying section. Accordingly, It is a disadvantage that the drying section becomes large.

Moreover, when the drying section is structured such that the radiation heat is utilized, it is proposed that material which has high emissivity and high thermal conductivity is applied to a conveying system of the drying section. However, because this conveying system is heated by the warm air, the radiation heat is not used actively.

Moreover, there is another problem that unevenness of drying state of the photosensitive material may occur due to blowing positions of the warm air not existing appropriately.

SUMMARY OF THE INVENTION

The present invention was developed in order to overcome the above-described drawbacks, and an object of the present invention is to provide a drying device which can perform drying efficiently without enlarging the drying device.

In order to achieve the above object, an image drying device of a first aspect of the present invention is a drying device for drying a wet image recording medium conveyed along a conveying path, comprising: a plate member disposed along the conveying path, the plate member including blowing holes through which a wind for drying is blown onto the image recording medium and facing the conveyed image recording medium; and a heating device for directly heating the plate member, the heating device being disposed on or inside the plate member.

In an image drying device of a second aspect of the present invention according to the first aspect, at least a surface, which faces the image recording medium, of the plate member comprises a material having high emissivity.

A drying device of a third aspect of the present invention is a drying device for drying a wet image recording medium conveyed on a conveying path, comprising: a plate member disposed along the conveying path, the plate member including blowing holes through which a wind for drying is blown onto the image recording medium and facing the conveyed image recording medium; a first heating device for directly heating the plate member, the heating device being disposed on or inside the plate member; and a second heating device disposed at a wind for drying supplying path for supplying the wind for drying to the blowing holes of the plate member, wherein the wind for drying is heated by both the first heating device and the second heating device.

In an image drying device of a fourth aspect of the present invention according to anyone of the first aspect through the third aspect, the device further comprises a conveying member for conveying the image recording medium, the conveying member facing the plate member and being disposed such that the conveyed image recording medium is interposed between the plate member and the conveying member, wherein the image recording medium is conveyed in a state in which an image recording surface of the image recording medium faces the plate member, and the image recording medium is conveyed in a state in which the image recording medium is pressed in a direction of the conveying member by one of wind pressure of the wind for drying blown from the blowing holes and negative pressure of a blowdown side of the wind for drying, such that the image recording medium does not surface-contact the plate member.

In an image drying device of a fifth aspect of the present invention according to anyone of the first aspect through the fourth aspect, at least one rib is provided at a surface, which faces the image recording medium, of the plate member, the rib extending both downstream in a conveying direction of the image recording medium and laterally in a width direction, from a substantial center of the plate member toward a substantial width-direction edge of the plate member, the width direction being orthogonal to the conveying direction.

In an image drying device of a sixth aspect of the present invention according to anyone of the first aspect through the fifth aspect, portions of blowing holes which are located in different positions in a conveying direction of the image recording medium and which are adjacent in a width direction of the plate member when viewing along the conveying direction, are overlapped.

In an image drying device of a seventh aspect of the present invention according to anyone of the first aspect through the sixth aspect, an opening rate of the blowing holes with respect to the plate member is equal to or more than 2% and equal to or less than 10%.

In an image drying device of an eighth aspect of the present invention according to anyone of the first aspect through the seventh aspect, a temperature sensor is disposed at the plate member.

The first aspect of the present invention will be described in detail.

Because the plate member is disposed at the position in which the plate member faces the image recording medium along the conveying path, and the heating device heats directly the plate member, the conveyed image recording medium is dried by a radiating heat of the heated plate member. At the same time, the wind for drying (a warm air) which is from the blowing holes formed on the plate member and which is heated by the heating device, is blown onto the image recording medium. Accordingly, the image recording medium can be dried further efficiently.

In particular, because the heating device heats directly the plate member, amount of the radiating heat can be made large. Therefore, drying speed (drying efficiency) can be improved. Further, because the wind for drying is heated by the heated plate thereby be a warm air, it can be suppressed that the warm air is cooled due to heat loss or the like from a duct by the time when the warm air reaches to the blowing holes. Also, a portion to be heated (heat capacity) is made relatively small. Accordingly, a time necessary for heating can be reduced. Further, in the present invention, the radiating heat of the plate member in which the blowing holes are provided is utilized, the radiating heat and the wind for drying can be utilized at a same portion, therefore, the enlargement of the device can be suppressed.

The second aspect of the present invention will be described in detail.

Because at least the surface, which faces the image recording medium, of the plate member is formed by the material having high emissivity (a total emissivity is equal to or more than 0.9), the radiating heat is transferred from the plate member heated by the heating device to the image recording medium efficiently. Accordingly, drying efficiency of the image recording medium can be improved.

The third aspect of the present invention will be described in detail.

Because the first heating device is provided at the plate member and the second heating device is provided at the wind for drying supplying path for providing the wind for drying to the blowing holes of the plate member, and the wind for drying is heated by both the first heating device and the second heating device, a temperature of the wind for drying can be made high efficiently. Accordingly, drying efficiency of the image recording medium can be improved.

The fourth aspect of the present invention will be described in detail.

The image recording medium which has reached to the drying device is conveyed in the state in which the image recording surface of the image recording medium faces the plate member. At this time, the image recording medium is conveyed in the state in which the image recording medium is pressed toward (and abutted on) the conveying member which is disposed to face the plate member, namely, in a state in which the plate member is apart from the image recording medium, by the wind pressure of the wind for drying blown from the blowing holes of the plate member or the negative pressure of the blowdown side of the wind for drying. Accordingly, it is prevented that the image recording medium is conveyed in a state in which the image recording medium slides with respect to the plate member by surface-contacting each other. Accordingly, it can be surely prevented that the image recording surface of the image recording medium is damaged.

The image recording medium may be made curled in the width direction which is orthogonal to the conveying direction in accompany with being dried, and therefore, the end portions of the image recording medium may abut the plate member. However, even when the end portions of the image recording medium in the width direction abut (line-contact) the plate member, the image recording surface of the image recording medium cannot be damaged.

The fifth aspect of the present invention will be described in detail.

The image recording medium being conveyed in the drying device may be made curled in the width direction which is orthogonal to the conveying direction in accompany as being dried. As a result, tip ends of the both end portions in the width direction of the image recording medium (hereinafter, tip corners) may slide on the plate member. At this time, it may happen that the tip corners enter the blowing holes formed in the plate member and the tip corners are damaged, and/or the image recording medium is jammed.

However, in this aspect, because at least one rib (protrusion) is provided at the surface, which faces the image recording medium, of the plate member, such that the rib extends toward the downstream side of the conveying direction of the image recording medium, from the substantial central portion of the plate member in the width direction which is orthogonal to the conveying direction, to the substantial end portion of the plate member in the width direction, the tip corners abutting the plate member are guided by the protrusions to move toward respective end portions of the plate member. Namely, the curled image recording medium is made to be plane by the protrusions. Therefore, an angle of the tip corner with respect to the plate member is made small. Accordingly, a possibility that the tip corners enter in the blowing holes can be reduced. Accordingly, the damaging of the image recording medium and/or the jamming of the image recording medium can be suppressed.

The sixth aspect of the present invention will be described in detail.

The blowing holes are disposed such that the portions of blowing holes located in different positions in the conveying direction of the image recording medium and neighboring each other in the width direction of the plate member when viewing along the conveying direction, are overlapped.

Namely, blowing holes are aligned in columns substantially orthogonal to the conveying direction, with blowing holes in respectively adjacent columns being offset in the conveying direction, such that blowing holes in respectively adjacent columns would partially overlap if a column were to be superimposed on an adjacent column in the conveying direction.

Accordingly, as the image recording medium is conveyed on the conveying path, the wind for drying can be blown onto the image recording medium in entire area in the width direction without non-uniformity. Therefore, unevenness of amount of the wind for drying blown onto the image recording medium in the width direction can be suppressed. Therefore, unevenness of drying state of the image recording medium can be suppressed.

The seventh aspect of the present invention will be described in detail.

The drying efficiency of the image recording medium by the wind for drying depends on a wind velocity of the wind for drying. In this aspect, the opening rate of the blowing holes with respect to guide plate is equal to or more than 2% and equal to or less than 10%. By this structure, the blowing speed (wind velocity) of the wind for drying is equal to or more than a predetermined value, the drying efficiency of the image recording medium can be improved.

DESCRIPTION OF THE PREFERRED EMBODIMENTS

Hereinafter, embodiments of the present invention will be described.

(First Embodiment)

Hereinafter, a processor applied thereto a drying device relating a first embodiment of the present invention will be described in detail with reference to the drawings.

(Entire Structure of Processor)

Figure 1:
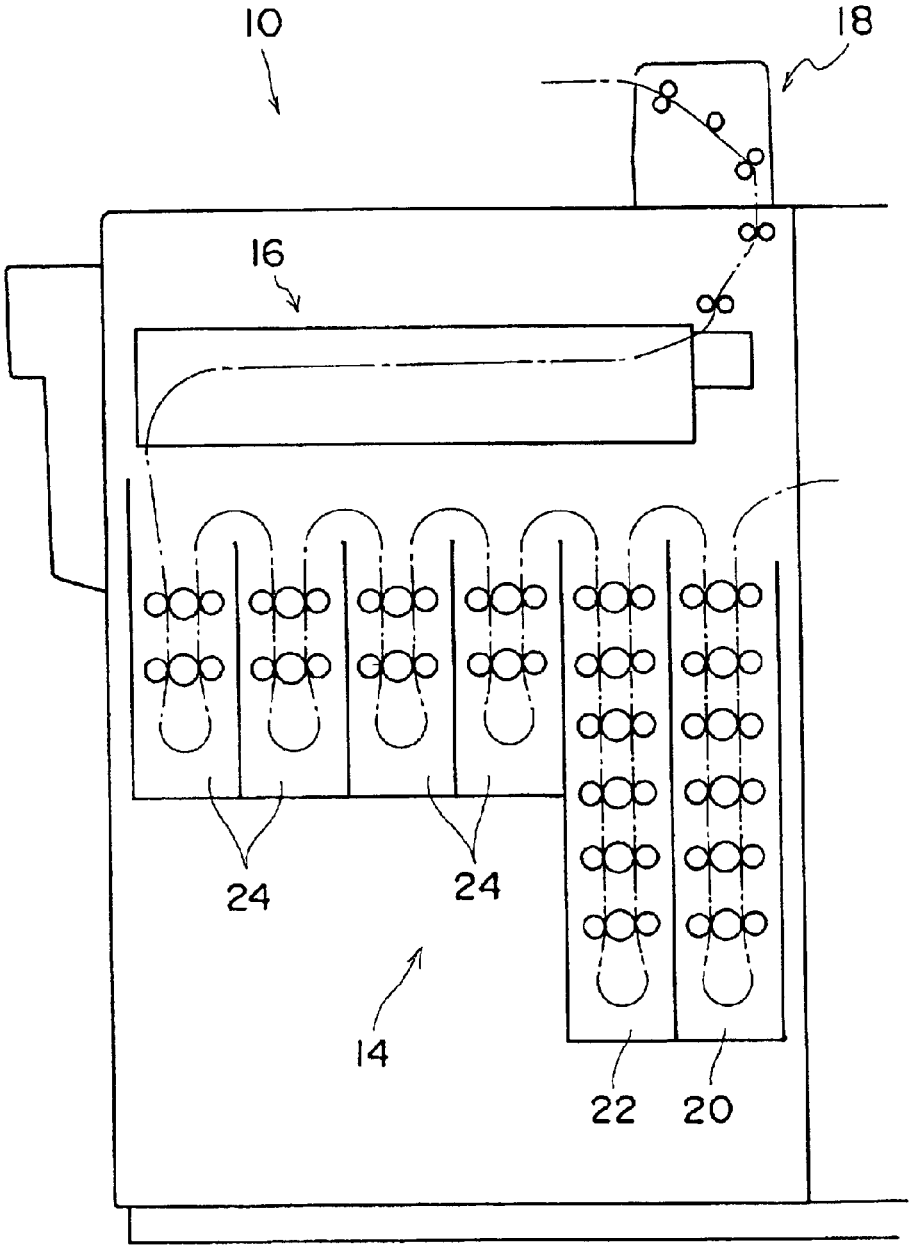
FIG. 1 is a schematic structural view of a processor relating to a first embodiment of the present invention.

A processor 10 is a device in which a photosensitive material, on which a latent image is formed by a printer (not shown in the drawings), is inserted, and the inserted photosensitive material is subject to developing processing and outputted as a print. Namely, as shown in FIG. 1, the processor 10 is provided with a developing section 14, a drying section 16 and a discharge section 18. The developing section 14 is provided with a developing tank 20, a fixing tank 22 and a washing tank 24 along a conveying path. At the developing section 14, by the photosensitive material being immersed in the developing tank 20, the fixing section 22 and the washing section 24 in order, the latent image formed on the photosensitive material is developed and fixed. At the drying section 16, the photosensitive material wetted at the developing section 14 is dried. The dried photosensitive material is discharged outside the processor at the discharge section 18.

(Structure of Drying Section)

Figure 2:
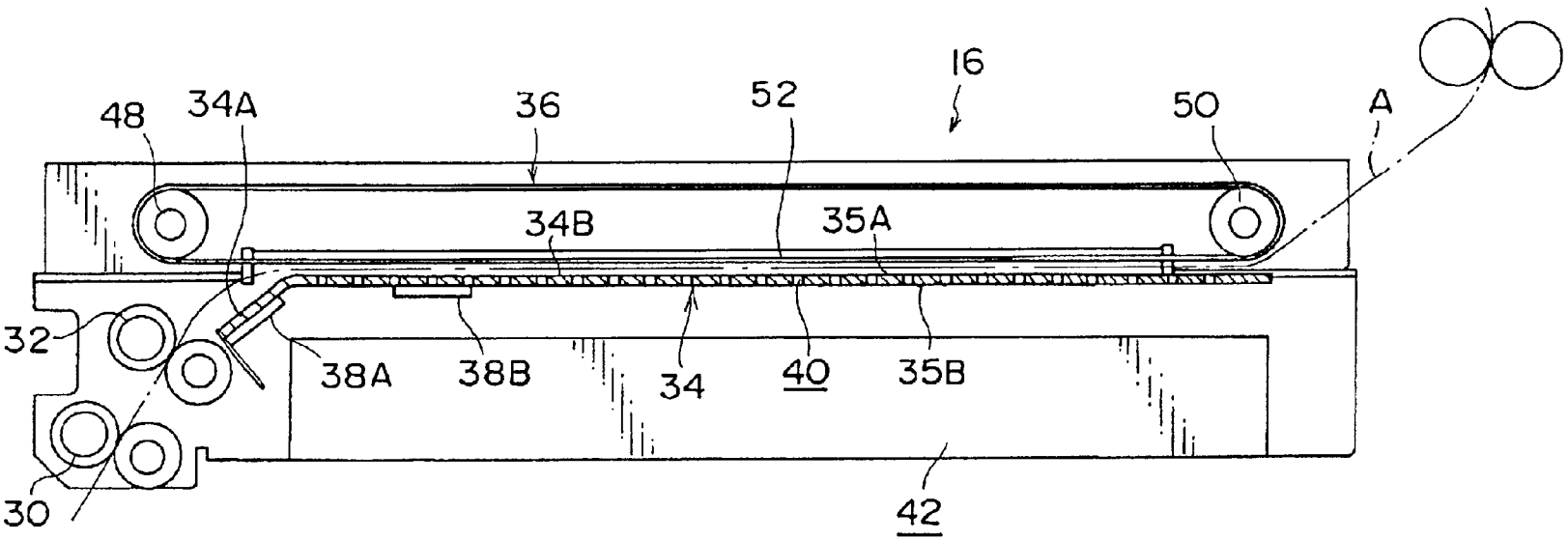
FIG. 2 is a schematic side view of a drying section relating to the first embodiment of the present invention.

As shown in FIG. 2, the drying section 16 is basically structured such that it is provided with pairs of squeeze rollers 30 and 32, a guide plate 34 and a conveying belt 36. The pairs of squeeze rollers 30 and 32 remove extra water from the photosensitive material which is conveyed from the developing section 14. The guide plate 34 guides the photosensitive material which has passed through the pair of squeeze rollers 32 toward the downstream side in a conveying direction. The conveying belt 36 is disposed at a position facing the guide plate 34 and conveys the photosensitive material.

As shown in FIG. 2, the guide plate 34 is provided with a sloped portion 34A and a horizontal portion 34B. The sloped portion 34A guides the photosensitive material which has passed through the pair of squeeze rollers 32 to a portion between the horizontal portion 34A and the conveying belt 36. The horizontal portion 34B is disposed so as to be substantially parallel with respect to the conveying belt 36.

The guide plate 34 is formed by aluminum, and a surface 35A of the guide plate 34, facing the photosensitive material, is painted (coated) in black. Accordingly, a thermal conductivity of the guide plate 34 is high, and therefore, an emissivity (a radiation rate) of the guide plate 34 with respect to the photosensitive material is also high. (A total emissivity is equal to or more than 0.9.)

Figure 2A:
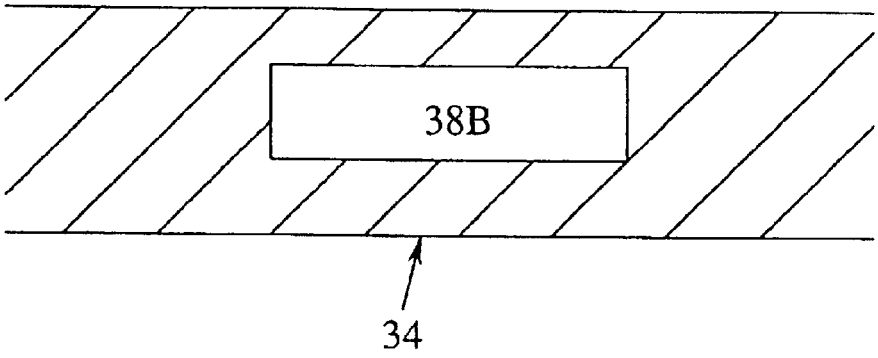
FIG. 2A shows a guide plate and a heater in an alternative embodiment of the present invention.

Ceramic heaters 38A and 38B are mounted on a lower side 35B of the guide plate 34. The photosensitive material is dried by a radiation heat of the guide plate 34 heated by the ceramic heaters 38A and 38B. FIG. 2A shows an alternative embodiment of the present invention in which ceramic heater 38B is disposed inside guide plate 34.

Figure 4:
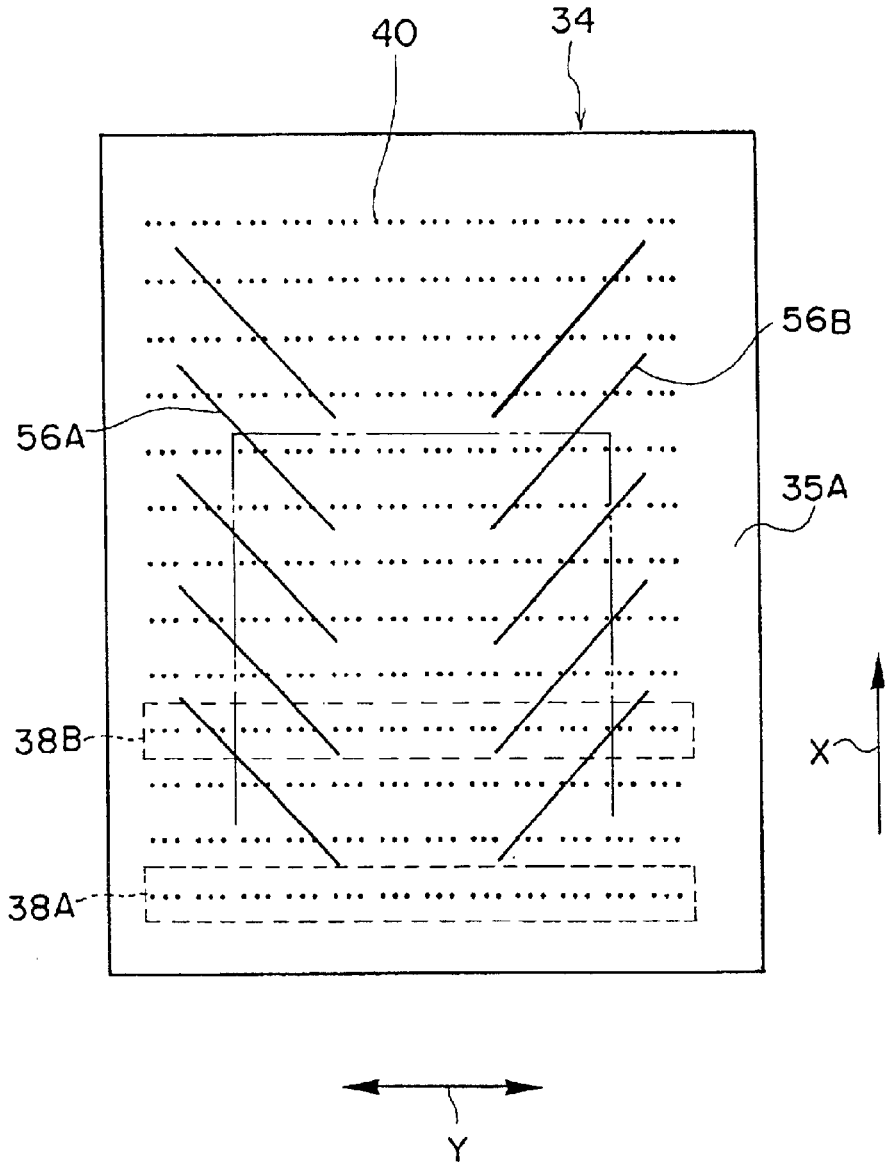
FIG. 4 is a plane view of a guide plate relating to the first embodiment of the present invention.

As shown by broken lines in FIG. 4, the ceramic heaters 38A and 38B extend in a width direction (a direction indicated by arrow "Y") which is orthogonal to the conveying direction (a direction indicated by "X"). Accordingly, unevenness of the amount of the radiation heat transferred to the conveyed photosensitive material in the width direction can be suppressed.

A plurality of nozzles 40 are disposed on the guide plate 34 in such a manner that a plurality of columns, in which nozzles 40 are arranged in the width direction of the guide plate 34 by a constant interval, are arranged in the conveying direction by a predetermined interval.

Figure 3:
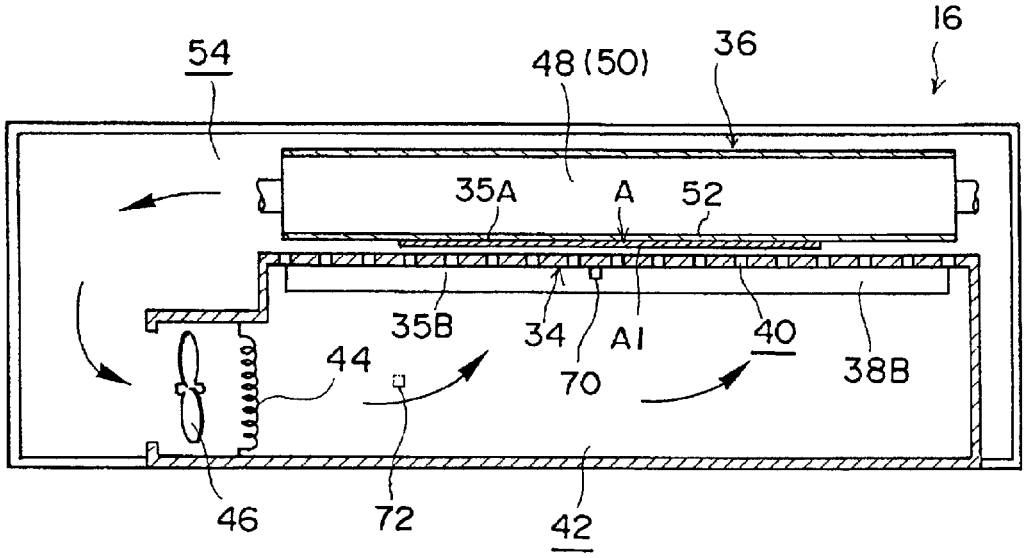
FIG. 3 is a schematic front view of the drying section relating to the first embodiment of the present invention.

The warn air is blown onto the photosensitive material, which is conveyed between the guide plate 34 and the conveying belt 36, passing through the nozzles 40. As shown in FIG. 3, air is heated by a heater 44 to a temperature substantially 60° C.–90° C., and the heated air (the warm air) is provided to a drying air supplying path 42 (hereinafter, a supplying path 42), which is formed at the lower side of the guide plate 34 in the width direction, by a fan 46, and then the warn air is provided to the photosensitive material through the nozzle 40. As shown in FIG. 3, a temperature sensor 70 is mounted on the guide plate 34. The heater 44 is feedback-controlled on the basis of the detected temperature detected by the temperature sensor 70.

Figure 5:
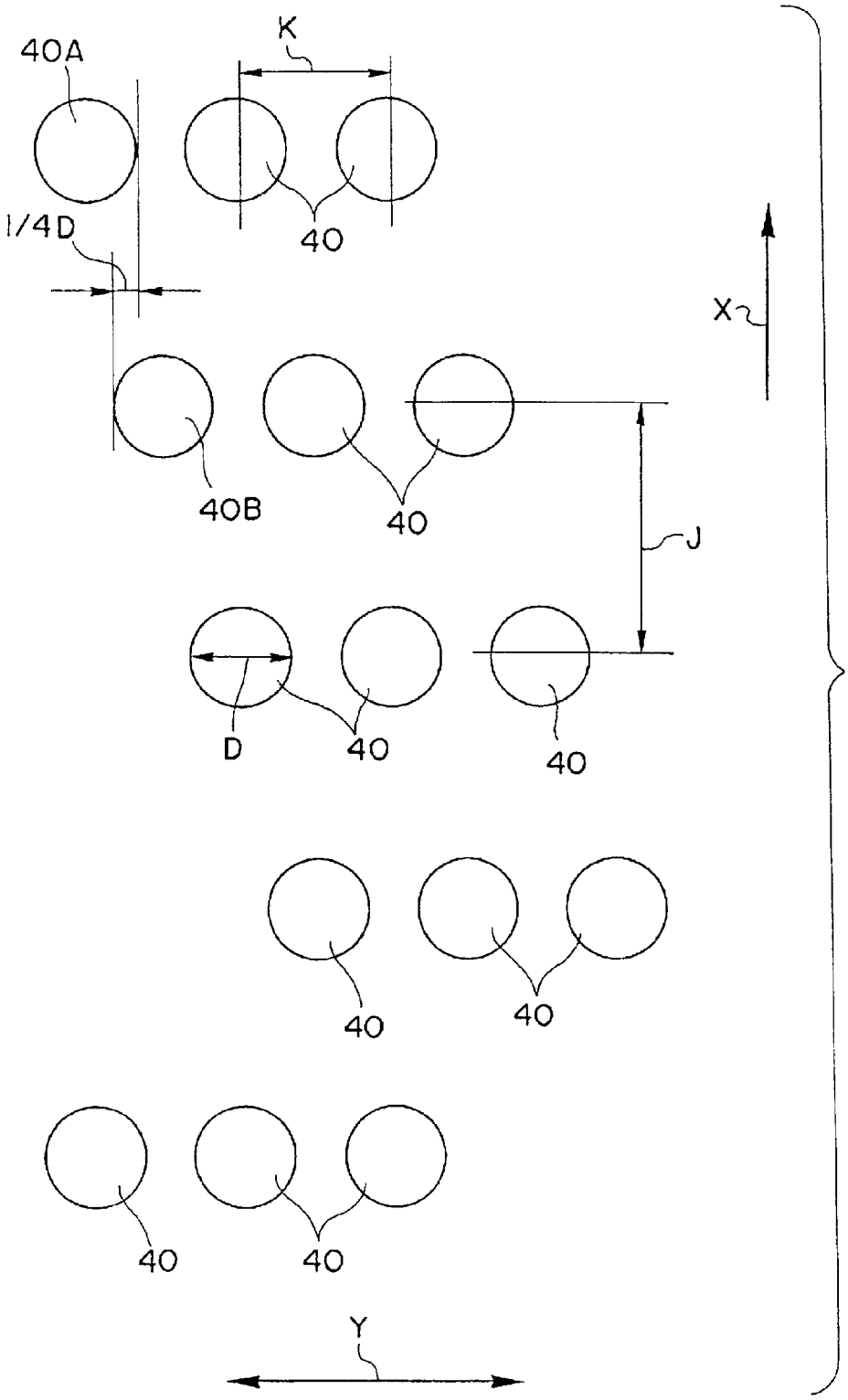
FIG. 5 is a structural plane view of arrangement of nozzles at the guide plate relating to the first embodiment of the present invention.

As shown in FIG. 5, each of the nozzles 40 has a circular hole portion having a diameter D. The nozzles 40 are arranged in the conveying direction (direction X) with intervals "J" and in the width direction (direction Y) with intervals "K". Nozzles 40 in columns neighboring (adjacent) each other in the conveying direction (for example, a nozzle 40A and a nozzle 40B in FIG. 5) are arranged to be overlapped in the width direction by (¼)D. Accordingly, by the photosensitive material being conveyed on the guide plate 34 in the conveying direction, the warm air is blown, without unevenness in the width direction, onto the photosensitive material. Therefore, unevenness of drying in the width direction of the photosensitive material can be suppressed. In a case in which the nozzle 40 has a circular cross-sectional configuration as described above, closer to an end of the opening portion of the nozzle 40 in the width direction, smaller an opening state of the opening portion, namely, smaller a length of the opening portion of the nozzle 40 in the conveying direction. (a length of the opening portion in the conveying direction at a center of the opening portion is equal to the diameter D, and a length of the opening portion in the conveying direction at the end of the opening portion in the width direction is 0.) However, because the nozzles 40 neighboring each other in the conveying direction are arranged to be overlapped in the width direction by (¼)D from each end of the nozzles 40 in the width direction, unevenness of amount of the warm air blown onto the photosensitive material, caused by such configuration of the nozzles 40, can be suppressed. Therefore, unevenness of drying state of the photosensitive material can be further suppressed. In the present embodiment, the nozzle 40 has a circle cross-sectional configuration, however, the nozzle 40 may has a ellipse cross-sectional configuration.

In the present embodiment, an opening rate of the nozzles 40 with respect to the horizontal portion 34B is equal to or less than 50%. By this structure, namely, by suppressing the opening rate to be low, it is possible that a blowing speed (a wind velocity) of the drying air (the warm air) blown onto the photosensitive material through the nozzle 40 is equal to or more than a predetermined value. Because a drying speed (a time necessary for drying the photosensitive material) depends on the wind velocity of the warm air blown onto the photosensitive material, the drying speed can be improved by increasing the blowing speed of the warm air.

As shown in FIG. 3, the warm air, which is blown from the nozzles 40 formed on the guide plate 34 in above described manner to the conveying belt side, refluxes to the supplying path 42 in such a manner that the warm air passes through an endless belt 52 and a returning duct 54. The endless belt 52 structuring the conveying belt 36 and formed by a mesh is wound between rollers 48 and 50. The a returning duct 54 extends in the width direction.

As shown in FIG. 4, a plurality of ribs 56A and ribs 56B are disposed on the surface 35A of the horizontal portion 34B of the guide plate 34 in the conveying direction with a predetermined interval. Each rib 54A extends so as to be inclined, from a substantially central portion of the guide plate 34 in the width direction to a one end of the guide plate 34 in the width direction, toward the downstream side of the conveying direction. Each rib 54B is extends so as to be inclined, from a substantially central portion of the guide plate 34 in the width direction to the other end of the guide plate 34 in the width direction, toward the downstream side of the conveying direction. Thus, a plurality of pairs of the 6 and 6 are arranged in the conveying direction with the predetermined interval. The photosensitive material is curled in the width direction thereof in accompany with being dried. However, the ribs 56A and ribs 56B can suppress curled amount of the photosensitive material by moving tip ends of the curled photosensitive material A toward respective width directions. Accordingly, the ribs 56A and ribs 56B prevent the photosensitive material A from being damaged due to that the tip end of the photosensitive material A is caught by the nozzles 40. Also, the ribs 56A and ribs 56B prevent the photosensitive material A from being jammed.

Next, the operation of thus structured processor 10 will be explained.

The sheet-like photosensitive material, in which latent images are formed by a printer (not shown in the drawings), is inserted into the developing section 14, and immersed in the developing tank 20, the fixing tank 22 and the washing tank 24 in order. Thus the images are fixed. Then, this wet photosensitive material is conveyed to the drying section 16 in a state in which image recording surface thereof faces bottom.

First, in the drying section 16, the photosensitive material passes through the pairs of the squeeze rollers 30 and 32, and extra water (most of the water) on the photosensitive material is removed, as shown in FIG. 2. The photosensitive material which has passed through the pairs of the squeeze rollers 32 is guided by the inclined portion 34A of the guide plate 34, and then the photosensitive material enters into a region between the horizontal portion 34B of the guide plate 34 and an endless belt 52of the conveying belt 36.

At this time, the photosensitive material is dried by the radiation heat from the guide plate 34 which is heated by the ceramic heaters 38A and 38B. Because the ceramic heaters 38A and 38B are structured so as to extend in the width direction, unevenness of amount of the radiation heat from the guide plate 34 which is heated in the width direction is suppressed. Namely, the radiation heat is uniformly, in the width direction, applied to the photosensitive material. Accordingly, non-uniformity of dried state of the photosensitive material by the radiation heat in the width direction is suppressed. Further, because the ceramic heater 38A is disposed at the inclined portion 34A and the ceramic heater 38B is disposed at the horizontal portion 34B in the vicinity of the inclined portion 34A (at the inclined portion 34A side), the largest amount of the radiation heat can be transmitted to the photosensitive material at a region in the vicinity of the pair of squeeze rollers 32 (at the pair of squeeze rollers 32 side), namely, at the upper stream side in the conveying direction, where the photosensitive material is in the most wet state. Accordingly, the drying efficiency is improved.

In particular, because the surface 35A (the photosensitive material side surface) of the guide plate 34 which is made of aluminum is painted in black, and a total emissivity is made to be equal to or more than 0.9, amount of the radiation heat from the guide plate 34 becomes large. Accordingly, the photosensitive material can be dried efficiently.

When the photosensitive material reaches a position in which the photosensitive material faces the horizontal portion 34B of the guide plate 34, the photosensitive material is conveyed in a state in which the photosensitive material is attached to the endless belt 52 of the conveying belt 36 by the warm air blown from the nozzles 40 of the guide plate 34 toward the photosensitive material (toward the endless belt 52), as shown in FIG. 3. Accordingly, because the photosensitive material is conveyed in a state in which the image recording surface A1 of the photosensitive material A is apart (spaced) from the guide plate 34, the image recording surface A1 of the photosensitive material A can be prevented from being scratched by sliding of the photosensitive material A and the guide plate 34 (the horizontal portion 34B).

Further, at this time, the warm air blown onto the photosensitive material is a warm air which is heated by the heated 44 in the supplying path 42, and further heated by the ceramic heaters 38A and 38B. Accordingly, because this warm air is heated by two heat sources, temperature of this warm air rises efficiently. Therefore, the drying is performed efficiently. Further, the warm air blown to the photosensitive material from the nozzles 40 passes through the endless belt 52 which is formed by the mesh, and returns to the supplying path 42 via the returning duct 54. Namely, because it is structured that the warm air refluxes by the fan 46 being driven, after the temperature of the warm air reaches to a predetermined value, the temperature of the warm air is maintained at the predetermined value efficiently.

Further, for example, when the present embodiment is compared to a case in which a temperature sensor 72 (shown in FIG. 3 by the dotted line) is provided at the supplying path 42, because the heater 44 is feedback-controlled on the basis of the detected temperature detected by the temperature sensor 70 which is provided at the guide plate 34 in the present embodiment, a temperature, which is substantially equal to or nearer the temperature at a position in which the photosensitive material A is dried, can be detected. Therefore, accuracy of the feedback-controlling is improved. As a result, the photosensitive material can be dried with further higher temperature.

Further, the nozzles 40 formed in the horizontal portion 34B of the guide plate 34 are arranged such that a nozzle 40 (for example, the nozzle 40A in FIG. 5) and a nozzle 40 positioned to be offset with respect to the nozzle 40A in the conveying direction (for example, the nozzle 40B in FIG. 5) are disposed so as to be overlapped each other in the width direction by (¼)D. Accordingly, the warm air can be blown onto the photosensitive material in entire area in the width direction without non-uniformity. Therefore, unevenness of drying state in the width direction of the photosensitive material can be further suppressed.

Further, in the present embodiment, an opening rate of the nozzles 40 with respect to the horizontal portion 34B of the guide plate is preferably equal to or less than 50%. By this structure, the blowing speed (wind velocity) of the drying air (warm air) is equal to or more than a predetermined value. Accordingly, drying efficiency which depends on the wind velocity of the warm air is improved.

Moreover, when the opening rate of the nozzles 40 becomes large, a distance between the openings of the nozzles 40 adjacent to each other becomes small. Therefore, strength of the guide plate (the horizontal portion 34B) becomes small due to a thickness (corresponding to the distance) between the nozzles 40 adjacent to each other being small. Further, it becomes difficult to form the nozzles in the guide plate (the horizontal portion 34B), for example, by a cutting die or the like, when the thickness between the nozzles 40 adjacent to each other is small. On the other hand, when the opening rate of the nozzles 40 becomes small, even if the blowing speed of the warm air from the nozzle 40 become faster, unevenness of drying state in the photosensitive material A may occur because the distance between the openings of the nozzles 40 adjacent to each other becomes large. Moreover, because amount of the warm air from the nozzle 40 becomes small, the drying efficiency becomes deteriorated. Accordingly, taking into consideration those, the opening rate of the nozzles 40 with respect to the horizontal portion 34B is, more preferably, equal to or more than 2% and equal to or less than 10%.

Figure 9:
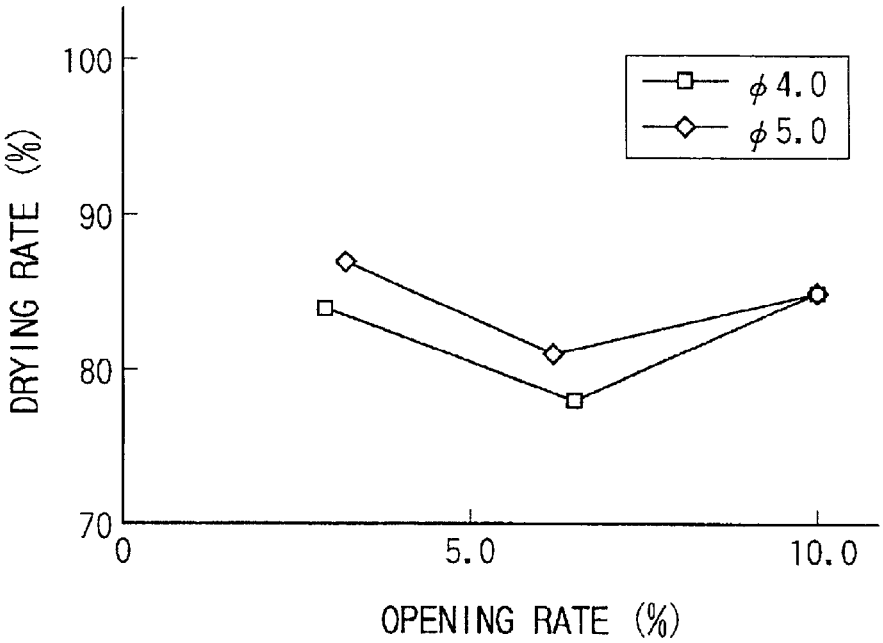
FIG. 9 is a graph showing a relation between a drying rate and an opening rate of nozzle.

FIG. 9 is a graph showing a relation between a drying rate and the opening rate in cases in which the diameter of the nozzle is 4.0 mm and 5.0 mm, which are selected by consideration of the drying characteristics. The drying rate is a value corresponding to the drying time which is necessary for the photosensitive material A being dried. Namely, smaller drying rate is preferable. It is clear from the FIG. 9 that the drying rate becomes minimum value when the opening rate is between 6% and 7% in both cases in which the nozzle is 4.0 mm and the nozzle is 5.0 mm, namely the most optimum point (an optimum opening rate) in the each case exists between 6% and 7%. Accordingly, the opening rate of the nozzles 40 with respect to the horizontal portion 34B is further preferably equal to or more than 6% and equal to or less than 7% in those cases.

Figure 6:
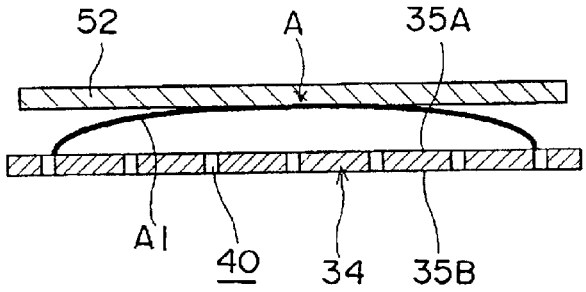
FIG. 6 is a front cross-sectional view of state of a photosensitive material at the drying section relating to the first embodiment of the present invention.

Further, in accompany with that the photosensitive material is conveyed toward the conveying downstream side on the horizontal portion 34B of the guide plate 34 by the conveying belt 36, the photosensitive material A curls in the width direction thereof due to being dried (see FIG. 6). As a result, end portions of the image recording surface A1 of the photosensitive material in the width direction abut the guide plate 34. However, because merely the end portions of the image recording surface A1 contact (line-contact) to the guide plate 34, namely, almost area of the image recording surface A1 does not contact the guide plate 34, the image recording surface A1 is prevented from being scratched.

Figure 7:
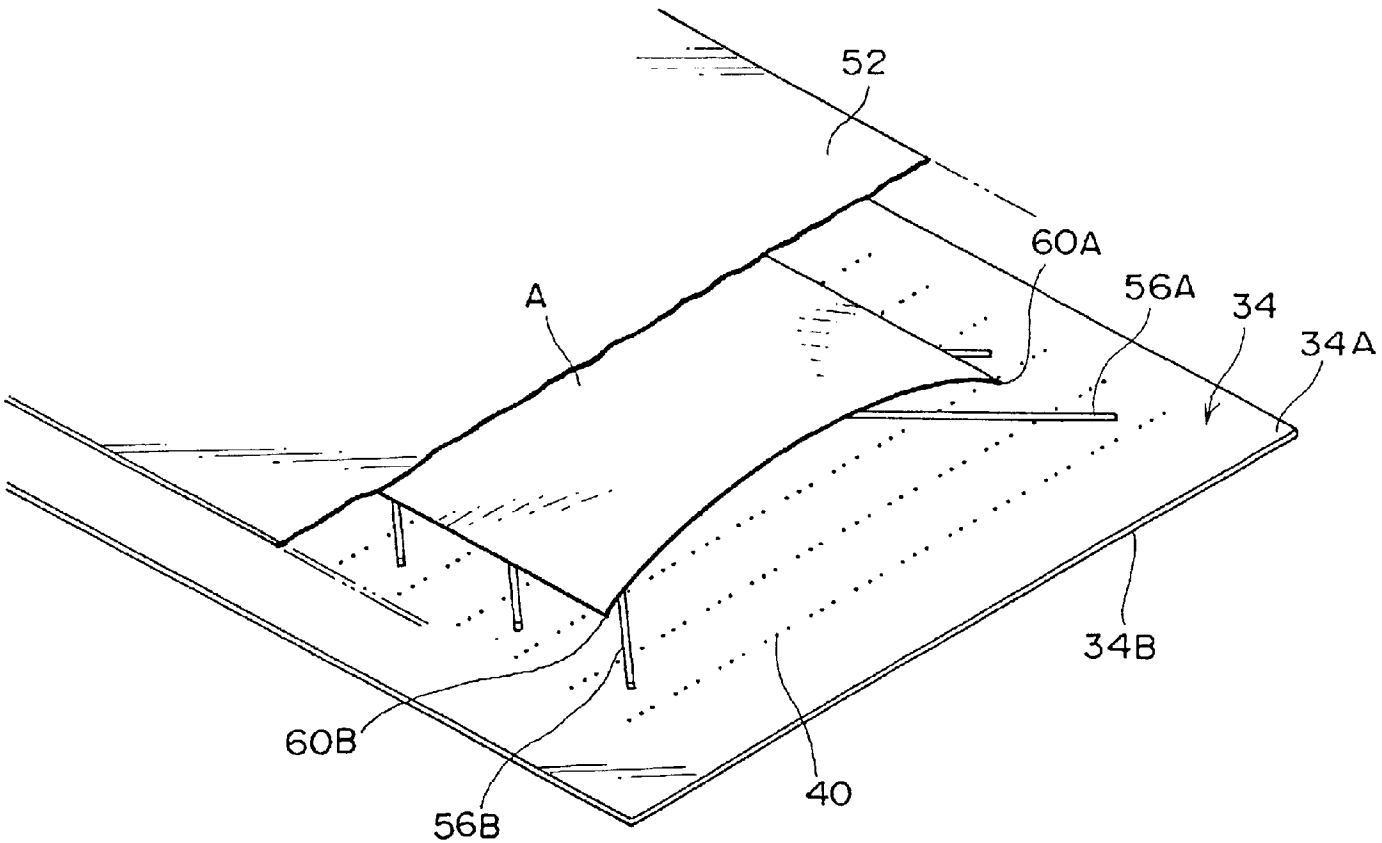
FIG. 7 is a perspective view of the state of the photosensitive material at the drying section relating to the first embodiment of the present invention

Further, as mentioned above, the tip ends 60A and 60B (hereinafter, corner portions) at the end portions in the width direction of the photosensitive material which is curled in the width direction are abut ribs 56A and 56B, as shown in FIG. 7. Therefore, the corner portions 60A and 60B are guided along the respective ribs 56A and 56B such that the corner portions 60A and 60B move toward respective both end portions in the width direction of the guide plate. As the result, as shown in FIG. 7, angles between the corner portions 60A and 60B (see FIG. 6), which substantially stood upright before being guided by the ribs 56A and 56B, with respect to the guide plate 34 in the width direction are made small. Accordingly, it can be surely prevented that the corner portions 60A and 60B are damaged, and/or the photosensitive material A is jammed, by that the corner portions 60A and 60B of the photosensitive material which is curled due to being dried are caught by the nozzles 40 when the photosensitive material is conveyed.

(Second Embodiment)

Next, a drying device relating to a second embodiment of the present invention will be described. The device relating this second embodiment is applied to an ink jet recording device. Note that portions which are the same as those of the first embodiment are denoted by the same reference numerals, and description thereof is omitted. Only portions which are different from the first embodiment will be described with reference to FIG. 8.

Figure 8:
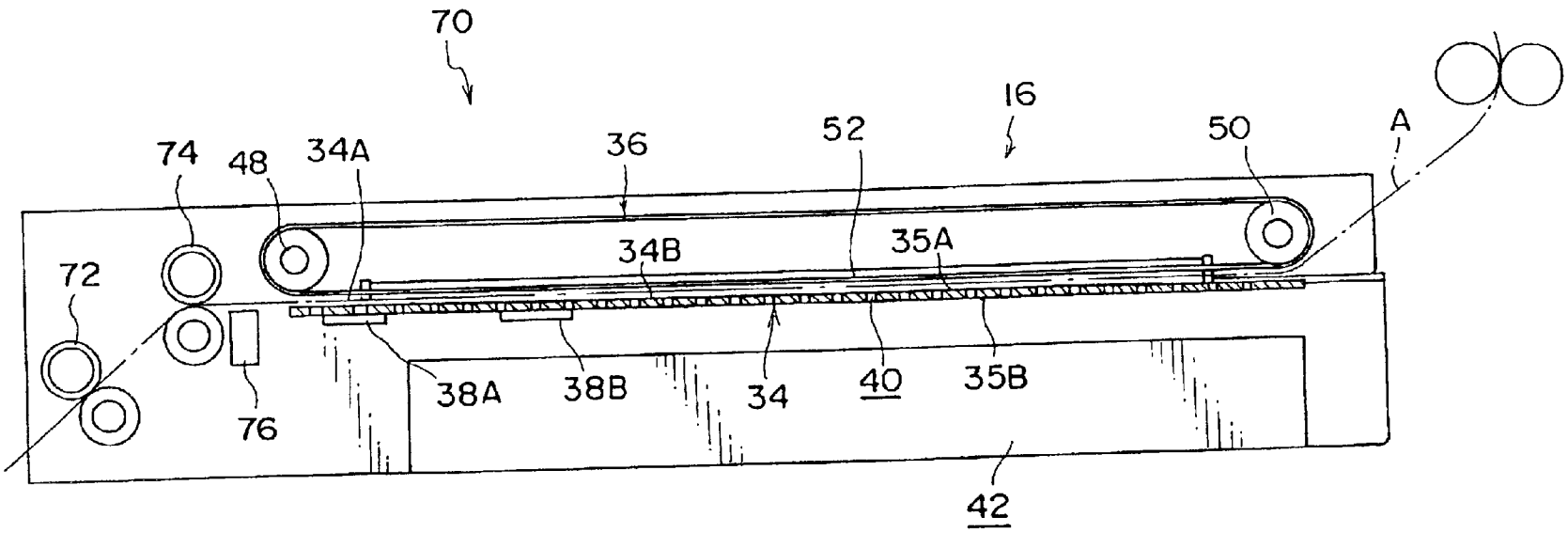
FIG. 8 is a schematic side view of a drying section relating to a second embodiment of the present invention.

As shown in FIG. 8, in the drying section 16 of the ink jet recording device 70, ink drops from an ink jet printing head 76 are applied (put) on a paper B conveyed by pairs of conveying rollers 72 and 74, therefore, the image is formed on the paper B. Hot air, which is from a blowing holes 40, is blown onto an image recording surface of the paper B on which the image is formed by the ink drops. Further, the paper B can be dried efficiently by the radiating heat which is from the guide plate 34.

In the drying device of the present invention, image recording medium can be dried efficiently.

What is claimed is:

1. A drying device for drying a wet image recording medium conveyed on a conveying path, comprising:

a plate member disposed along the conveying path, the plate member including blowing holes through which a wind for drying is blown onto the image recording medium and facing the conveyed image recording medium, wherein the plate member comprises a sloped portion and a horizontal portion, the horizontal portion being disposed parallel to the conveying path;

a first heating device for directly heating the plate member, the heating device being disposed on or inside the plate member, wherein the first heating device is disposed on the sloped portion of the plate member;

a second heating device disposed at a wind for drying supplying path, wherein the wind for drying supplying path supplies the wind for drying to the blowing holes of the plate member, the second heating device being disposed on the horizontal portion of the plate member, wherein the wind for drying is heated by both the first heating device and the second heating device.

2. A drying device for drying a wet image recording medium conveyed on a conveying path, comprising:

a plate member disposed along the conveying path, the plate member including blowing holes through which a wind for drying is blown onto the image recording medium and facing the conveyed image recording medium, wherein the plate member comprises a sloped portion and a horizontal portion, the horizontal portion being disposed parallel to the conveying path;

a first heating device for directly heating the plate member, the heating device being disposed on or inside the plate member, wherein the first heating device is disposed on the sloped portion of the plate member;

a second heating device disposed at a wind for drying supplying path, wherein the wind for drying supplying path supplies the wind for drying to the blowing holes of the plate member, the second heating device being disposed on the horizontal portion of the plate member, wherein the wind for drying is heated by both the first heating device and the second heating device, and wherein a total area of the blowing holes with respect to an area of the plate member is from approximately 2% to approximately 10%.

3. A drying device according to claim 2, wherein at least a surface, which faces the image recording medium, of the plate member comprises a material having high emissivity.

4. A drying device according to claim 2 further comprising a conveying member for conveying the image recording medium, the conveying member facing the plate member and being disposed such that the conveyed image recording medium is interposed between the plate member and the conveying member, wherein the image recording medium is conveyed in a state in which an image recording surface of the image recording medium faces the plate member, and the image recording medium is conveyed in a state in which the image recording medium is pressed in a direction of the conveying member by one of wind pressure of the wind for drying blown from the blowing holes and negative pressure of a blowdown side of the wind for drying, such that the image recording medium does not surface-contact the plate member.

5. A drying device according to claim 2, wherein at least one rib is provided at a surface, which faces the image recording medium, of the plate member, the rib extending both downstream in a conveying direction of the image recording medium and laterally in a width direction, from a substantial center of the plate member toward a substantial width-direction edge of the plate member, the width direction being orthogonal to the conveying direction.

6. A drying device according to claim 2, wherein portions of blowing holes overlap when viewed along the conveying direction, the blowing holes located in different positions in a conveying direction of the image recording medium and adjacent in a width direction of the plate member.

7. A drying device according to claim 2, wherein a temperature sensor is disposed at the plate member.

* * * * *